US005397120A

United States Patent [19]

Schulz et al.

[11] Patent Number: 5,397,120

[45] Date of Patent: Mar. 14, 1995

[54] APPARATUS FOR STACKING SHEETS

[75] Inventors: Friedrich Schulz; Wolfgang Faust; Norbert Rilitz; Arthur van Wijk, all of Hamburg, Germany

[73] Assignee: E.C.H. Will GmbH, Hamburg, Germany

[21] Appl. No.: 196,853

[22] Filed: Feb. 10, 1994

[30] Foreign Application Priority Data

Feb. 24, 1993 [DE] Germany ..... 43 05 579.6

[51] Int. Cl.[6] ..... B65H 43/04

[52] U.S. Cl. ..... 271/198; 271/214; 271/312

[58] Field of Search ..... 271/197, 198, 214, 215, 271/217, 307, 312; 414/794.4

[56] References Cited

U.S. PATENT DOCUMENTS

| | | | |
|---|---|---|---|
| 3,729,188 | 4/1973 | Stephenson . | |
| 3,971,554 | 7/1976 | Stange | 271/212 |
| 4,547,113 | 10/1985 | Welch et al. | 271/217 |
| 4,775,141 | 10/1988 | Trenzen | 271/198 |
| 5,064,185 | 11/1991 | Ricciardi . | |

FOREIGN PATENT DOCUMENTS

| | | | |
|---|---|---|---|
| 1461212 | 12/1968 | Germany . | |
| 1461219 | 5/1977 | Germany . | |
| 0125563 | 7/1983 | Japan | 271/198 |
| 0239059 | 9/1990 | Japan | 271/215 |
| 2183222 | 6/1987 | United Kingdom | 271/215 |

OTHER PUBLICATIONS

Bach, IBM Technical Disclosure Document, Paper Inserter and Stacker Bin, Feb. 1975, pp. 2535–2536.

*Primary Examiner*—H. Grant Skaggs
*Attorney, Agent, or Firm*—Darby & Darby

[57] ABSTRACT

An apparatus for stacking successive rapidly advancing sheets of a stream of sheets has a platform which receives successive sheets and descends at the rate of accumulation of one or more stacks thereon. The sheets are delivered by one or more overhead belt conveyors in cooperation with one or more lower belt conveyors. The front end turn of the lower reach of each overhead conveyor is deflected around a small-diameter rigid rod immediately in front of a stop for the leaders of successive sheets to reduce the likelihood of buckling during stacking, and one or more downwardly sloping ramps are provided in front of the stop to deflect the leaders of successive sheets in a downward direction toward the leaders of the immediately preceding sheets in immediate or close proximity of the stop. The stop, the rod and the overhead conveyor or conveyors are adjustable in several directions to facilitate a change of setup for the stacking of longer, shorter, wider or narrower sheets. At least one of the ramps has one or more openings for the front end turn or turns of the overhead conveyor or conveyors.

11 Claims, 3 Drawing Sheets

APPARATUS FOR STACKING SHEETS

BACKGROUND OF THE INVENTION

The present invention relates to improvements in apparatus for stacking sheets, and more particularly to improvements in apparatus for converting one or more series or streams of successive sheets into one or more series of stacks or piles wherein the sheets accurately overlap each other. Still more particularly, the invention relates to improvements in apparatus for converting at least one series or stream of partially overlapping or non-overlapping sheets into a succession of stacks or piles on a support which is movable between an upper level (for reception of the lowermost sheet of a stack) and a lower level (for reception of the uppermost sheet of a stack). Still more particularly, the invention relates to improvements in sheet stacking apparatus wherein one or more endless overhead conveyors constitute or form part of means for transporting successive sheets of at least one series or stream of sheets against an abutment which serves as a stop for the leaders of successive sheets. If the sheets of at least one series or stream of sheets are transported along a substantially horizontal path, the abutment or stop is normally provided with a surface which confronts the oncoming sheets of the at least one series or stream and is normal or substantially normal to the path, i.e., the surface of the abutment or stop is normally located in or at least close to a vertical plane.

Apparatus of the type to which the present invention pertains can be utilized with advantage to simultaneously accumulate two or more sets of successive stacks from two or more series or streams of overlapping or non-overlapping sheets which are obtained by converting a relatively wide web of flexible sheet material into two or more narrower strips and by subdividing each strip into a succession of partially overlapping sheets (i.e., into imbricated or scalloped streams of sheets) or into a succession of non-overlapping sheets (i.e., into one or more streams wherein the trailing end of a preceding sheet does not overlap or is not overlapped by the leader of the immediately following sheet).

The apparatus of the present invention can be utilized with advantage for the stacking of sheets which consist of paper, metallic foil, plastic foil, textile material of woven or nonwoven fabric and/or any other flexible sheet-like material which is or which can be subdivided or formed into panels of a particular size for the stacking of such panels on top of one another. The invention will be described in greater detail in connection with the stacking of paper sheets having identical sizes but it is to be understood that sheets of a material other than paper can be stacked in the same way or in a similar way.

It is well known to convert a relatively wide running web of paper into two or more narrower webs or strips which are advanced lengthwise (the same as the wide web) and are thereupon acted upon by one or more cross cutters so that each strip yields a succession of discrete sheets having a width corresponding to that of the respective strip and a selected length. The thus obtained sheets can be converted into streams of successive partially overlapping (imbricated or scalloped) sheets or into streams wherein the leader of each next-following sheet overlies or is overlapped by the trailing end of the immediately preceding sheet. The sheets or each stream are normally gathered into a succession of stacks each having a predetermined number of preferably accurately overlapping sheets so that the stacks can be readily draped into panels of paper or other wrapping material prior to transport into storage or prior to introduction into boxes, crates or other types of receptacles.

Problems arise when the sheets of a stream of successive partially overlapping or non-overlapping sheets are relatively thin and relatively wide and/or relatively long. Such relatively wide and/or relatively long sheets are often used for conversion into blanks of documents having a particular format. The relatively thin and relatively large (e.g., relatively wide and/or relatively long) sheets must be handled with great care in order to ensure that their leaders will accurately overlie each other and will not undergo deformation during and/or as a result of stoppage at the stacking station. Otherwise stated, the transporting means and the stop for the leaders of such sheets must be designed to avoid deformation of and/or other damage to successive sheets during the last stage of advancement to the stacking station. The transporting means (particularly the customary overhead conveyor or conveyors of such transporting means) and the stop must cooperate to prevent buckling of the leaders of successive sheets during stoppage at the stacking station, as well as to ensure that each of a short or long series of successive sheets which are to form a stack is located in a predetermined plane not only during the last stage of transport toward the stop but also within the growing or fully grown pile at the stacking station.

OBJECTS OF THE INVENTION

An object of the invention is to provide an apparatus which is constructed and assembled and which can operate in such a way that it can properly stack narrow or wide, short or long as well as relatively stiff or readily flexible sheets of paper, woven or non-woven textile, metallic, plastic or other material.

Another object of the invention is to provide an apparatus which can accurately and gently stack relatively stiff as well as highly flexible sheets at a high frequency and irrespective of the size and/or shape of the sheets.

A further object of the invention is to provide novel and improved means for transporting sheets in a stacking apparatus of the above outlined character.

An additional object of the invention is to provide novel and improved means for controlling the movements of the leaders of successive sheets in a stream of partially overlapping or non-overlapping sheets in an apparatus of the above outlined character.

Still another object of the invention is to provide a novel and improved method of manipulating sheets in an apparatus for stacking highly sensitive sheets.

A further object of the invention is to provide an apparatus which can be used for simultaneous stacking of two or more discrete series of non-overlapping or partially overlapping sheets of paper or other flexible material.

SUMMARY OF THE INVENTION

The invention is embodied in an apparatus for converting a series of panels or sheets of paper, metallic foil, woven or non-woven textile material, plastic foil or other flexible sheet-like material into stacks. The improved apparatus comprises a stack-supporting platform which is movable from an upper level to a lower level during accumulation of a stack of superimposed sheets, and means for transporting successive sheets of the series in a predetermined direction along an elongated path (for example, along a horizontal or substantially horizontal path) having a discharge end above the upper level. Each sheet of the series of sheets has a leader during transport along the elongated path, and the apparatus further comprises an abutment for the leaders of successive sheets of the series. The abutment confronts the discharge end of the path at the upper level, and the transporting means comprises at least one endless flexible overhead conveyor including a lower reach overlaying the path above the upper level and having a front end turn which is disposed at the abutment. The transporting means further comprises a deflector for the front end turn of the at least one overhead conveyor, and the deflector is immediately adjacent the abutment.

In accordance with a desirable feature of the invention, the front end turn of the at least one overhead conveyor includes first and second portions making an acute angle and a third or intermediate portion which connects the first and second portions and overlies a portion of the deflector, i.e., such third portion of the front end turn is trained over the deflector. The latter can include an elongated rod, and the front end turn of the at least one overhead conveyor is trained over such rod. The latter can be a rigid rod and the apparatus can further comprise a holder which non-rotatably supports or mounts the rod.

The apparatus can also comprise at least one ramp for the leaders of successive sheets of the series at the abutment. The at least one ramp has an opening for the front end turn of the at least one overhead conveyor and a surface which slopes downwardly toward the upper level in the predetermined direction to thus direct the leaders of successive sheets of the series against a portion of the abutment which is located at a predetermined level. The surface of the at least one ramp and the elongated path preferably make an acute angle, most preferably a relatively small acute angle.

The transporting means can comprise at least two endless flexible overhead conveyors which are spaced apart from each other as seen transversely of the predetermined direction. The ramp is then provided with an opening for the front end turn of each overhead conveyor. Such apparatus preferably further comprises an additional or intermediate ramp between the openings for the front end turns of the at least two overhead conveyors. The additional ramp has a surface which slopes downwardly in the predetermined direction and serves to divert the leaders of successive sheets of the series of sheets against the aforementioned portion of the abutment. Such apparatus can further comprise a mobile carriage for the ramps and guide means serving to support the carriage for movement transversely of the predetermined direction. The deflector is or can be mounted on the guide means, and the apparatus can further comprise means for adjusting the guide means relative to the elongated path. Such adjusting means can comprise means for pivoting the guide means about an axis which extends transversely of the predetermined direction.

The apparatus can comprise fluid-operated (e.g., pneumatic) means for diverting the leaders of successive sheets of the series of sheets toward the platform at the abutment. The diverting means can comprise at least one nozzle which serves to discharge at least one streamlet of pressurized gaseous fluid.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
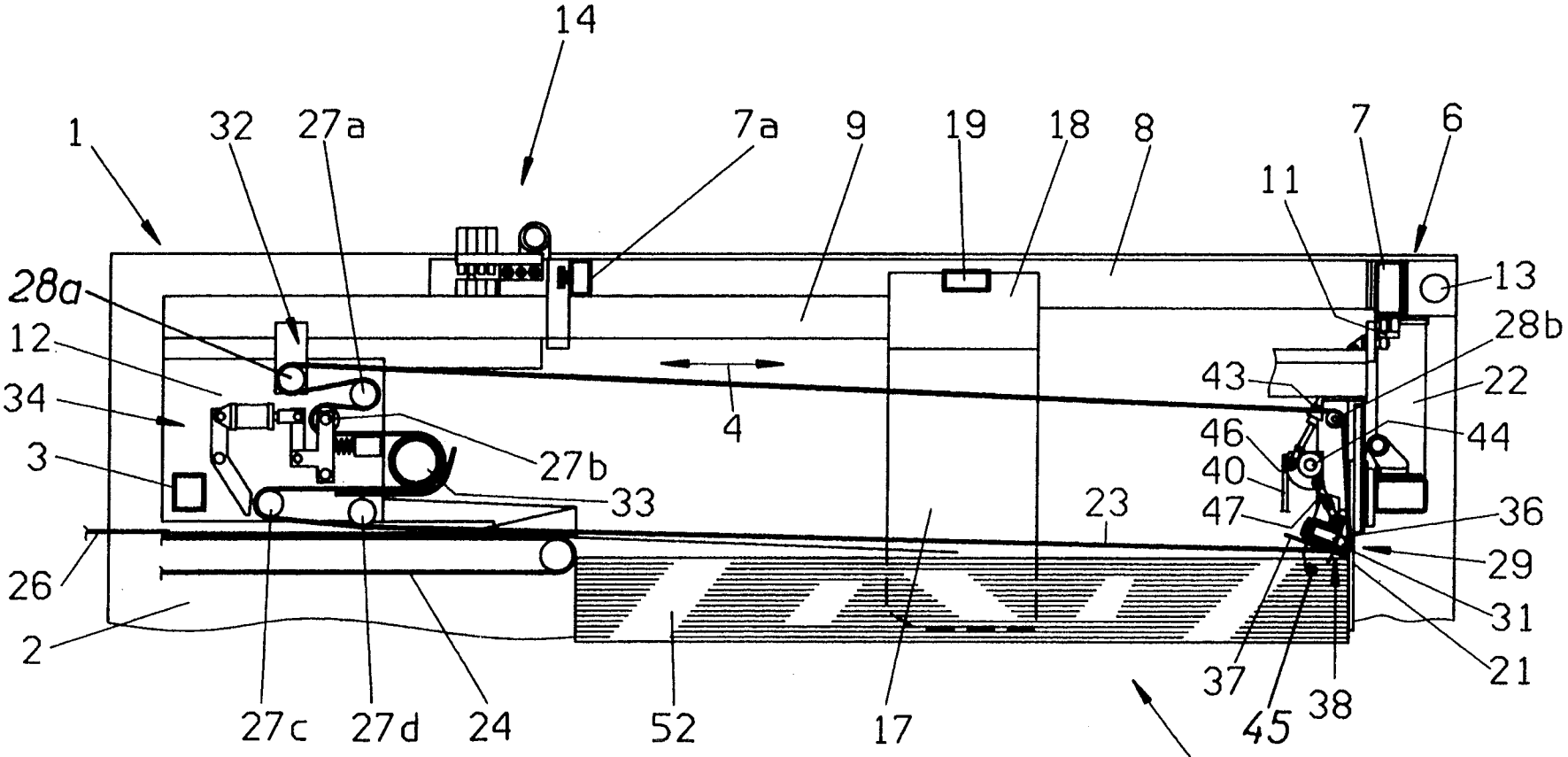
FIG. 1 is a longitudinal sectional view through a stacking apparatus which embodies one form of the present invention.

FIG. 1 illustrates a stacking apparatus which constitutes an improvement over and a further development of the apparatus disclosed in the commonly owned copending patent application Ser. No. 07/922,054 filed Jul. 29, 1992 by Alfred Besemann for "Apparatus for manipulating sheets or webs of paper". To the extent which is necessary for even fuller understanding of the present invention, the disclosure of the copending patent application of Alfred Besemann is incorporated herein by reference. The drawings merely show those component parts of the improved stacking apparatus which are necessary for the understanding of the present invention by those skilled in the relevant art.

The apparatus of FIGS. 1 is designed or can be utilized for simultaneous accumulation of two or more stacks of discrete paper sheets 26. A frame 1 includes a plurality of sidewalls, of which one is shown at 2, and a plurality of transversely extending connecting members 3 between the sidewalls. The frame 1 accommodates a slide or carriage 6 which is reciprocable in directions indicated by a double-headed arrow 4. The illustrated slide 6 comprises transversely extending components 7, *7a* and longitudinally extending components 8 (one shown in FIG. 1) between the components 7, *7a*. The slide 6 further comprises transversely extending tracks 11 (only one shown) for a longitudinally extending mobile carriage or bridge 9 serving as a holder for a rigid elongated rod 31 forming part of a deflector 29 to be fully described hereinafter. The bridge 9 cooperates with a supporting carrier 12 which is adjustable along the illustrated connecting member 3 in directions at right angles to the plane of FIG. 1. The arrangement is such that the bridge 9 is movable relative to the supporting carrier 12 in directions which are indicated by the double-headed arrow 4.

Figure 2:
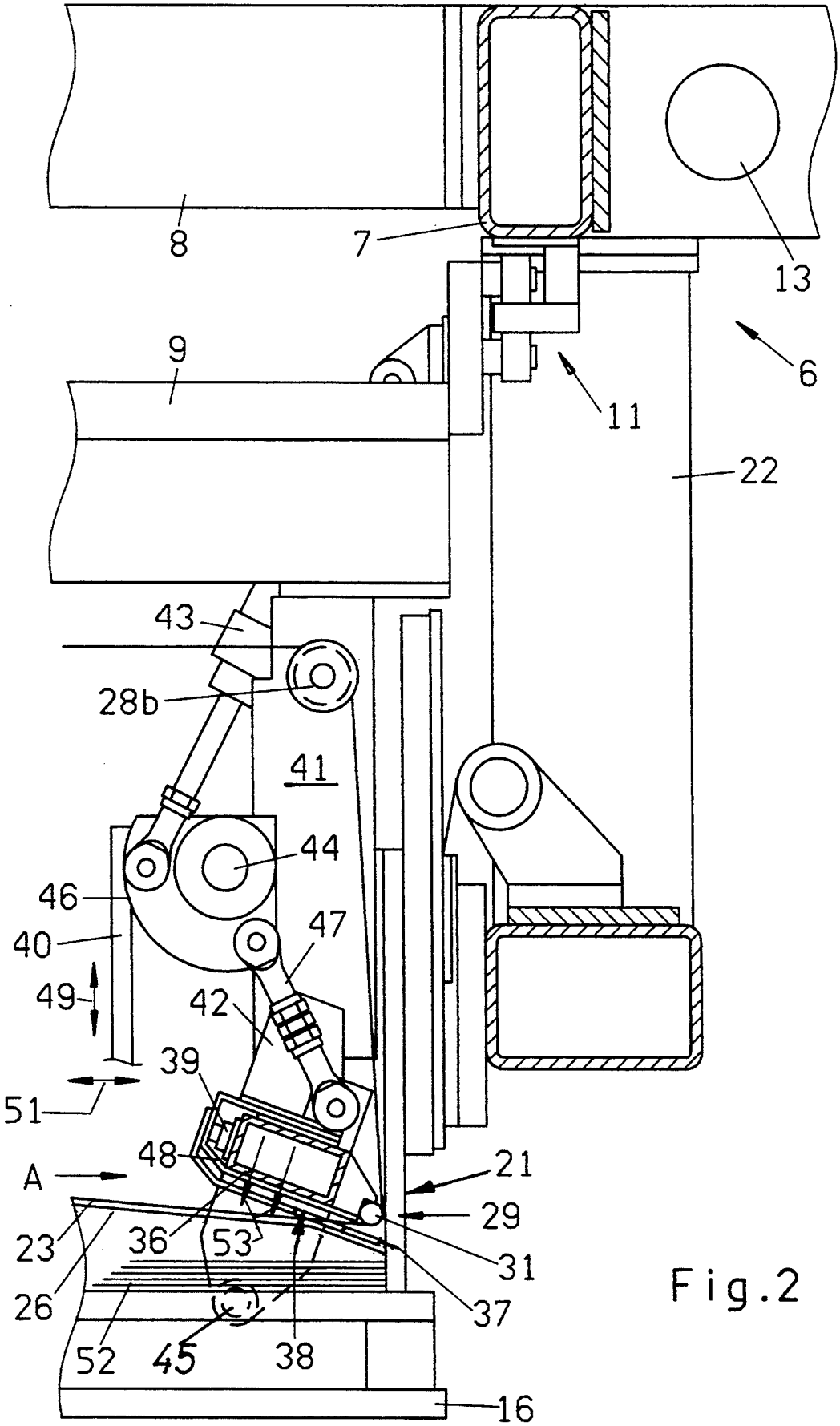
FIG. 2 is an enlarged view of a detail in the apparatus of FIG. 1.

The sheet transporting unit of the improved stacking apparatus is designed to advance successive sheets 26 of one or more streams or series of partially overlapping or non-overlapping sheets 26 in a direction to the right, as viewed in FIG. 1 or 2, i.e., in the direction which is indicated by the arrow A of FIG. 2. A drive which is constructed and assembled to move the slide 6 in the directions indicated by the arrow 4 is shown at 13, and a second drive 14 serves to advance the bridge 9 at right angles to the plane of FIG. 1 or 2.

Successive sheets 26 are transported in the direction of the arrow A along an elongated path at or slightly above the upper level of movability of a vertically movable platform or support 16 for one or more stacks or piles 51 of accurately overlapping sheets 26. The platform 16 is movable between the upper level and a lower level by a suitable elevator (e.g., an elevator including one or more fluid-operated cylinder and piston units of any known design) preferably at a rate which is proportional to the rate of feeding of the sheets 26 and is also a function of the thickness of such sheets. The bridge 9 supports a lateral aligning member 17 which is mounted on a slide 18, and such slide 18 is adjustable in directions which are indicated by the arrow 4. In addition, the slide 18 is adjustably mounted on one or more rails or tracks 19 for movement transversely of the plane of FIG. 1.

The slide 6 has a front end portion (the right-hand end portion, as viewed in FIG. 1 or 2) supporting an abutment 21 for the leaders of successive sheets 26. The abutment 21 is mounted on a bridge 22 which is movable along the transversely extending component 7 of the slide 6, i.e., at right angles to the direction of advancement of successive sheets 26 toward the abutment 21. The lower portion of the abutment 21 rests or can rest on the platform 16 for the stacks 52. The arrangement is such that the abutment 21 descends with and at the same rate as the platform 16 during accumulation of one or more stacks or piles 52 on the platform.

The bridge 9 and the carrier 12 support two endless flexible overhead belt conveyors 23 (hereinafter called belts) which form part of the unit for transporting successive sheets 26 toward and against the abutment 21. The transporting unit further comprises one or more additional endless belt conveyors 24 having upper reaches which support from below a series of successive partially overlapping sheets 26 which, in the apparatus of FIGS. 1 to 3, together form a scalloped or imbricated stream coming, for example, from one or more cross cutters (not shown) serving to subdivide one or more continuous running webs or strips into sheets 26 of selected length. Each such sheet 26 has a front end portion or leader and a trailing or rear end portion. Depending on the mode of forming the scalloped stream or streams, the leader of each next-following sheet 26 in a stream can overlie the trailing end of the immediately preceding sheet or the trailing end of each preceding sheet can overlie the leader of the immediately following sheet.

The upper or overhead belt or belts 23 have lower reaches which engage successive sheets 26 of the adjacent stream or streams of overlapping sheets. Each such overhead belt 23 is trained over four pulleys 27*a*, 27*b*, 27*c*, 27*d* which are mounted on or in the supporting carrier 12 (the latter does not move in or counter to the direction which is indicated by the arrow A), and each overhead belt 23 further comprises a front end turn having an intermediate portion which is trained over the deflector 29. The latter is immediately adjacent that side or surface of the abutment 21 which confronts the oncoming sheets 26 and this deflector comprises the aforementioned elongated rigid rod 31 having a relatively small or a very small diameter and being non-rotatably mounted or being adapted to be non-rotatably mounted in the slide 9 to be movable therewith transversely of the directions indicated by the arrow 4. The belt or belts 23 are further trained over one or more pulleys 28*a* which are mounted in the bridge 9 at a level above the pulleys 27*a* to 27*d* and cooperate with the pulley 27*a* to constitute a magazine 32 for storage of a variable length of a belt 23 in order to compensate for variations of that length of the belt 23 which extends between the pulley 27*d* and the rod 31 of the deflector 29; such changes of the length of the belt portion between the pulley 27*d* and the rod 31 will take place in response to shifting of the slide 6 relative to the frame 1. Each belt 23 is further trained over an additional pulley 28*b* which is mounted in the bridge 9 at a level above the rod 31 of the deflector 29. The means for driving the overhead belt or belts 23 includes a rotor 33 in the form of a roller which is driven by a motor or another suitable prime mover. The rotor 33 acts as a driven pulley and is positioned in such a way that a portion of each overhead belt 23 is trained around this rotor between the pulley or pulleys 27*b* and 27*c*.

In order to ensure unimpeded movements of the bridge 9 and belt or belts 23 transversely of the direction of advancement of the sheets 26, the belt or belts 23 can be disengaged from (i.e., moved away from contact with) the rotor 33. The mechanism for disengaging the belt or belts 23 from the rotor 33 is shown at 34; the exact construction of such mechanism (shown as including a linkage supporting the pulley 27*b* on the supporting carrier 12) forms no part of the present invention.

The elongated rigid rod 31 of the deflector 29 for the overhead belt or belts 23 is closely adjacent the neighboring side or surface of the abutment 21 and engages the aforementioned intermediate portion of the front end turn of each belt 23. Such intermediate portion is located between two additional (first and second) portions which make an acute angle. FIG. 2 shows that such acute angle can be somewhat less than 90°. The rod 31 is secured to a crosshead 36 extending transversely of the path of advancement of the sheets 26 and is further adjacent a deflecting device 37 which can be made of a suitable metallic sheet material and will be called a ramp having a surface sloping toward the upper level of the platform 16 in the direction of the arrow A and making a relatively small acute angle with the elongated path for the sheets 26. The ramp 37 has a slot-shaped, window-shaped or otherwise configurated opening 38 for the front end turn of the lower reach of each belt 23. The ramp 37 is mounted on a carriage 39 for movement with the belt 23 longitudinally of the stationary crosshead 36. To this end, the ramp 37 is connected to the bridge 9 which is adjustable in dependency on the selected format of the sheets 26. The motion transmitting connection includes an entraining element 41 which can be made of metallic sheet material and lugs 42 which are provided on the ramp 37. In order to facilitate the adjustment transversely of the path of advancement of the sheets 26, namely to reduce the stretching or tensioning action of the rod 31 upon the intermediate portion of the front end turn of a belt 23, the crosshead 36 is adjustable (pivotable) about the axis of a shaft 45 which is carried by a sidewall 40. The means for adjusting the crosshead 36 comprises a fluid-operated motor including a cylinder-piston unit 43 whose piston rod can turn a disc-shaped segment 46 about a shaft 44 extending in parallelism with the shaft 45. The cylinder and piston unit 43 is pivotably connected with the bridge 22 of the slide 6, and the shaft 45 is mounted in the sidewall 40. A connecting rod 47 of variable length is provided to move the crosshead 36 inwardly and away from the abutment 21.

The ramp 37 at least partially surrounds an additional ramp 48 which extends the full length of the crosshead 36 and has a surface making an acute angle with the elongated path for advancement of successive sheets 26 toward the abutment 21.

The arrows 49 and 51 denote in FIG. 2 the directions of adjustability of the sidewall 40 (i.e., up and down and in and counter to the direction which is indicated by the arrow A). The sidewall 40 carries the crosshead 36 and hence the rod 31 of the deflector 29. The just described adjustability of the sidewall 40 and crosshead 36 (e.g., by two rack and pinion drives or by fluid-operated motors) renders it possible to select an optimum position of the elongated rigid rod 31 of the deflector 29 relative to the abutment 21.

Figure 3:
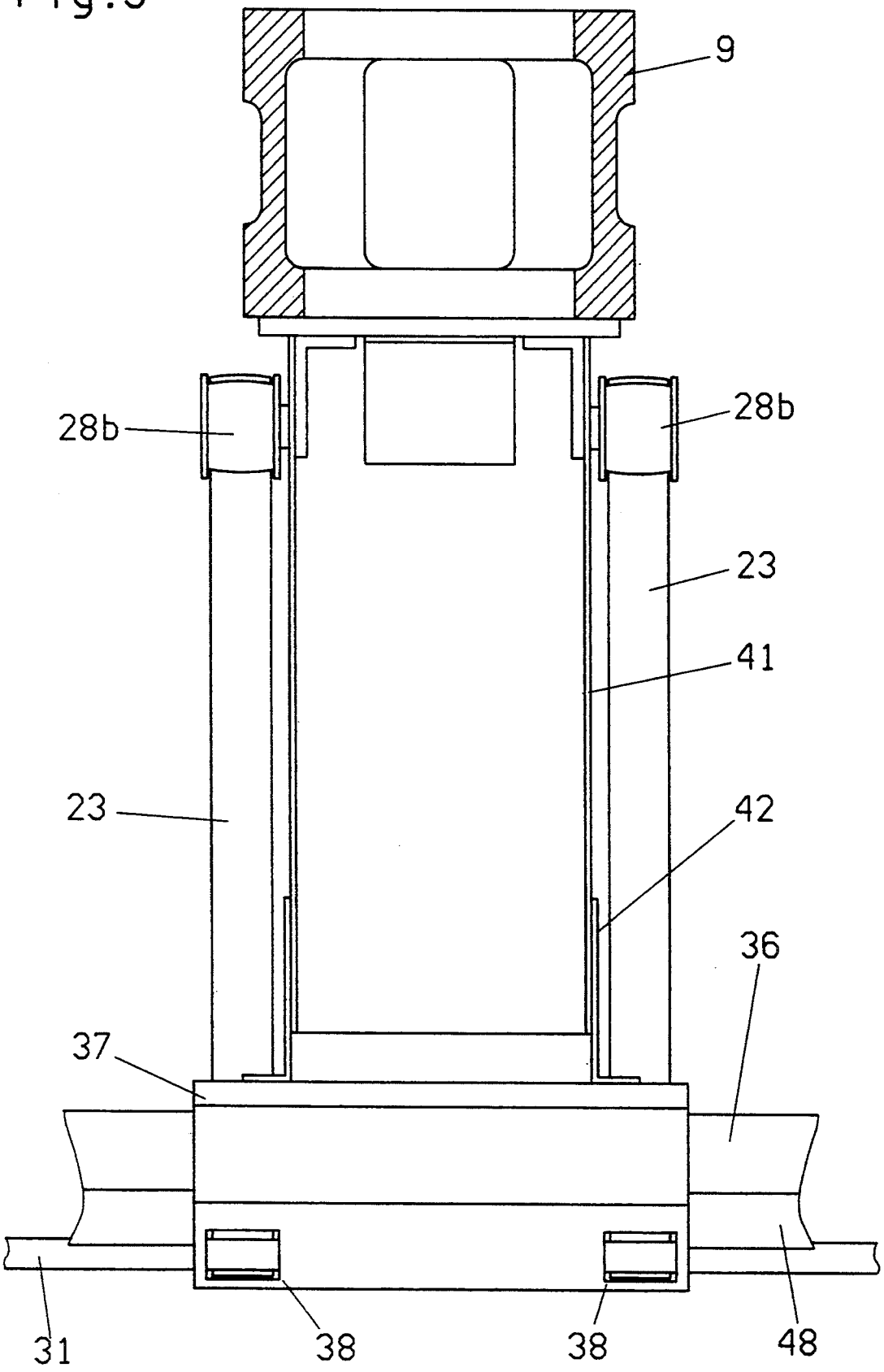
FIG. 3 is a view of a detail substantially as seen in the direction of arrow A in FIG. 2.

When the stacking apparatus of FIGS. 1 to 3 is in actual use, the overhead belt or belts 23 cooperate with the lower belt or belts 24 of the transporting unit to advance successive sheets 26 of the scalloped stream on the upper reach or reaches of the belt or belts 24 in the direction of the arrow A. The overhead belt or belts 23 ensure that the leader of each sheet 26 is advanced all the way to the abutment 21. As the leader of a sheet 26 approaches the confronting surface of the abutment 21, it is caused to move downwardly and forwardly along the adjacent sides of the ramp or ramps 37 and additional ramp 48. In other words, the last stage of advancement of the leader of each sheet 26 includes a combined forward and downward movement toward the abutment 21 and toward the platform 16, respectively. This reduces the likelihood of buckling of the leaders of successive sheets 26 during the last stage of their movement on top of the uppermost sheets forming part of the descending pile or stack 52 on the platform 16.

In addition to or in lieu of the ramps 37 and 48, the improved apparatus can comprise pneumatic diverting or direction changing means, e.g., in the form of one or more nozzles serving to blow one or more jets or streams of a compressed gaseous fluid (such as air) in the directions which are indicated by the arrows 53 in the lower portion of FIG. 2. To this end, the crosshead 36 can constitute a tube which has an intake end connected to the outlet of a fan, a blower, a pump or another source of pressurized fluid and one or more nozzles each having one or more orifices serving to discharge jets or streamlets of pressurized fluid in the directions indicated by the arrows 53.

An important advantage of the improved apparatus is that readily foldable or ready to crinkable sheets can be transported at an elevated speed and in such a way that their leaders accurately overlie each other on the platform 16 or on another suitable support. This contributes to the homogeneousness and more satisfactory appearance of successively accumulated piles or stacks 52 and to convenience of confining successive piles or stacks in wrappers of paper, transparent plastic foil or the like.

Another important advantage of the improved apparatus is that it can be rapidly and accurately converted for the making of stacks or piles consisting of shorter, longer, wider, narrower, thicker or thinner sheets of paper, metallic foil, plastic foil, non-woven or woven textile fabric or the like.

A further important advantage of the improved apparatus is that a change of setup merely necessitates an adjustment of the overhead belt or belts 23 whereas the position of the abutment 21 can remain unchanged.

Still another important advantage of the improved apparatus is that its operation can be automated to any desired degree and that its speed can be regulated at will to determine the rate of accumulation of successive sheets 26 into stacks or piles 52 of desired height.

The placing of the rod 31 of the deflector 29 into immediate or very close proximity to the abutment 21 renders it possible to employ an abutment which presents to the leaders of successive sheets 26 an uninterrupted vertical or substantially vertical surface. This not only promotes the making of stacks 52 with accurately overlapping flat sheets 26 but also simplifies the adjustment of the adjacent sheet guiding and advancing parts when the apparatus is to be converted for the transport and stacking of wider or narrower sheets. In other words, the sheet-arresting surface of the abutment 21 need not be provided with windows or other openings for the front end turn(s) of the lower reach(es) of the belt(s) 23; this greatly simplifies the shifting of such belt or belts in directions at right angles to that which is indicated by the arrow A.

It is possible to replace the rigid and non-rotatably mounted rod 31 of the deflector 29 with a one-piece small-diameter roller or with a series of aligned-small diameter rollers. The utilization of a rod 31 is preferred at this time because this contributes to simplicity, reduced space requirements and lower cost of the apparatus.

The ramp 37 also contributes to simplicity, lower cost and greater reliability of the improved apparatus. The left-hand side or surface of this ramp (as viewed in FIG. 1 or 2) makes with the path for the sheets 26 a relatively small acute angle which ensures more predictable deposition of each and every sheet 26 in its entirety (i.e., also of the leaders of such sheets) even if the sheets are large and readily flexible, e.g., if the sheets are of the type often used for the making of stacks of blank forms or the like. The provision of one or more openings 38 in the ramp 37 for the front end turn or turns of one or more overhead belts 23 does not affect the aforediscussed desirable features of the ramp 37. The latter prevents the leaders of successive sheets 26 from following the front end turn(s) of the belt(s) 23, i.e., the leaders of the sheets 26 do not tend to advance with the belt or belts 23 around the rod 31 and toward the pulley or pulleys **28*b*. Moreover, buckling of the leaders of the sheets 26** is prevented in a surprisingly simple and effective manner.

The additional ramp 48 operates behind the openings 38 of several discrete ramps 37 or behind the openings 38 of a single ramp 37 to further reduce the likelihood of buckling and/or other deformation of the leaders of successive sheets 26 in the region of the rod 31 of the deflector 29. The left-hand side or surface of the additional ramp 48 (again as viewed in FIGS. 1 and 2) also makes an acute angle with the adjacent portion of the path for successive sheets 26 on their way toward the confronting surface of the abutment 21.

The common crosshead 36 for the belt or belts 23 and for the ramp or ramps 37 contributes to the simplicity of a change of setup (for the transport of wider or narrower sheets), and the crosshead 36 also supports the deflector 29 and is movable with the bridge 9.

The changes of setup for the transport of wider or narrower sheets are further facilitated by the provision of the adjusting means including the parts 43, 46 and 47 for the crosshead 36; this ensures that the belt or belts 23 are not subjected to excessive tensional stresses during selection of the effective width of the path for successive sheets of one or more streams of non-overlapping or partially overlapping sheets.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An apparatus for converting a series of sheets into stacks, comprising a stack-supporting platform movable from an upper level to a lower level;

means for transporting successive sheets of the series in a predetermined direction along an elongated path having a discharge end above said upper level, each sheet of said series having a leader during transport along said path;

an abutment for the leaders of successive sheets, said abutment confronting said discharge end at said upper level, said transporting means further comprising a deflector for said front end turn, said deflector being immediately adjacent said abutment; and at least one ramp for the leaders of successive sheets at said abutment, said at least one ramp including a surface sloping downwardly toward said upper level in said direction to direct the leaders of successive sheets of the series against a predetermined portion of said abutment, said transporting means comprising two endless flexible conveyors spaced apart from each other transversely of said direction, said ramp having an opening for the front end turn of each of said conveyors, at least one of said two endless flexible conveyors including a lower reach overlying said path above said upper level and having a front end turn disposed at said abutment, and further comprising an additional ramp behind said openings, said additional ramp having a surface sloping downwardly in said direction and arranged to divert the leaders of successive sheets of said series against said predetermined portion of said abutment.

2. The apparatus of claim 1, wherein the front end turn of said at least one conveyor includes first and second portions making an acute angle and a third portion connecting said first and second portions and overlying a portion of said deflector.

3. The apparatus of claim 1, wherein said deflector includes an elongated rod and said front end turn is trained over said rod.

4. The apparatus of claim 3, wherein said rod is rigid and further comprising a holder non-rotatably mounting said rod.

5. The apparatus of claim 1, wherein said surface of said at least one ramp and said path make an acute angle.

6. The apparatus of claim 1, further comprising a mobile carriage for said deflector and said conveyors, and guide means supporting said carriage for movement transversely of said predetermined direction.

7. The apparatus of claim 6, wherein said deflector is mounted on said guide means.

8. The apparatus of claim 6, further comprising means for adjusting said guide means relative to said path.

9. The apparatus of claim 8, wherein said adjusting means comprises means for pivoting said guide means about an axis extending transversely of said direction.

10. The apparatus of claim 1, further comprising fluid-operated means for diverting the leaders of successive sheets of said series of sheets toward said platform at said abutment.

11. The apparatus of claim 10, wherein said diverting means includes at least one nozzle arranged to discharge at least one streamlet of pressurized gaseous fluid.

* * * * *